US011061357B2

(12) United States Patent
Ooka et al.

(10) Patent No.: US 11,061,357 B2
(45) Date of Patent: Jul. 13, 2021

(54) IMAGE FORMING APPARATUS WITH ROTATION-CONTROLLABLE PHOTOSENSITIVE DRUM AND MOVABLE DEVELOPING ROLLER

(71) Applicant: BROTHER KOGYO KABUSHIKI KAISHA, Nagoya (JP)

(72) Inventors: Kazuaki Ooka, Nagoya (JP); Keigo Nakajima, Nagoya (JP); Masahito Saeki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/722,420

(22) Filed: Dec. 20, 2019

(65) Prior Publication Data

US 2020/0301351 A1 Sep. 24, 2020

(30) Foreign Application Priority Data

Mar. 19, 2019 (JP) ..... JP2019-051559

(51) Int. Cl.
*G03G 21/16* (2006.01)
*G03G 15/08* (2006.01)
*G03G 21/18* (2006.01)

(52) U.S. Cl.
CPC ..... *G03G 21/1647* (2013.01); *G03G 15/0887* (2013.01); *G03G 21/1633* (2013.01); *G03G 21/1864* (2013.01)

(58) Field of Classification Search
CPC ..... G03G 21/1647; G03G 15/0887; G03G 21/1633; G03G 21/1864; G03G 15/0121; G03G 15/5008
See application file for complete search history.

(56) References Cited

U.S. PATENT DOCUMENTS

2007/0160388 A1* 7/2007 Yoshimura ..... G03G 21/1647 399/111
2015/0093145 A1* 4/2015 Tomatsu ..... G03G 21/1633 399/110

FOREIGN PATENT DOCUMENTS

JP 2012-128017 A 7/2012

* cited by examiner

*Primary Examiner* — Sandra Brase
(74) *Attorney, Agent, or Firm* — Merchant & Gould P.C.

(57) ABSTRACT

An image forming apparatus, having a casing, a cover, a first motor, a photosensitive drum, a second motor, a developing motor, a clutch, a contact/separation cam, a switching cam, and a controller, is provided. The controller conducts a first process, in which, when the cover is moved from an open position to a closed position, the controller drives the first motor to rotate the photosensitive drum without causing rotation of the developing roller; and a second process, in which, after a lapse of a first period since the controller started driving the first motor, the controller drives the second motor to move the contact/separation cam from the first phase to the second phase and move the switching cam from the first phase to the second phase causing the developing roller to be moved from the contacting position to the separated position while the photosensitive drum is rotating.

6 Claims, 10 Drawing Sheets

IMAGE FORMING APPARATUS WITH ROTATION-CONTROLLABLE PHOTOSENSITIVE DRUM AND MOVABLE DEVELOPING ROLLER

CROSS REFERENCE TO RELATED APPLICATION

This application claims priority from Japanese Patent Application No. 2019-051559, filed on Mar. 19, 2019, the entire subject matter of which is incorporated herein by reference.

BACKGROUND

Technical Field

An aspect of the present disclosure is related to an image forming apparatus.

Related Art

A conventional image forming apparatus may include a photosensitive drum, a developing roller, a contact/separation cam, and a motor. The developing roller may be movable between a contacting position, in which the developing roller contacts or abuts on the photosensitive drum, and a separated position, in which the developing roller is separated from the photosensitive drum. The contact/separation cam may move the developing roller between the contacting position and the separated position. The motor may cause the contact/separation cam to rotate.

SUMMARY

While the contact/separation cam and the motor may cause the developing roller to move between the contacting position and the separated position, the behaviors of the contact/separation cam and the motor may not cause the developing roller to stop rotating even after the developing roller is placed at the separated position. In other words, the developing roller may keep rotating in the separated position as well as when in the contacting position.

However, when the developing roller is at the separated position, the developing roller is not used for image forming. Therefore, in order to keep the developing roller from being impaired, it may be preferable that the developing roller is restrained from rotating when the developing roller is at the separated position.

In order to restrain the developing roller at the separated position from rotating, the rotation of the developing roller may be controlled to be stopped in conjunction with a separating action of the developing roller to separate from the photosensitive drum. In particular, in an action to move the developing roller from the contacting position to the separated position, the developing roller may be separated from the photosensitive drum while being rotated, and the rotation of the developing roller may be stopped at a timing when the developing roller is located at the separated position.

In this regard, however, if the rotating developing roller starts moving from the contacting position to the separated position while the photosensitive drum stays still without rotating, the developing roller may idle on a surface of the photosensitive drum and rub a part of the surface of the photosensitive drum that is in contact with the rotating developing roller intensively. Thus, the surface of the photosensitive drum may have undesirable abraded marks created by the rubbing behavior of the rotating developing roller.

The present disclosure is advantageous in that an image forming apparatus, in which abraded marks on a surface of a photosensitive drum may be restrained while rotation of the developing roller is stoppable at a position separated from a photosensitive drum, is provided.

According to an aspect of the present disclosure, an image forming apparatus, having a casing, a cover, a first motor, a photosensitive drum, a second motor, a developing motor, a clutch, a contact/separation cam, a switching cam, and a controller, is provided. The casing includes an opening. The cover is movable between a closed position, in which the cover closes the opening, and an open position, in which the opening is exposed. The photosensitive drum is configured to rotate by a driving force from the first motor. The developing roller is movable between a contacting position, in which the developing roller contacts the photosensitive drum, and a separated position, in which the developing roller is separated from the photosensitive drum. The clutch is located between the second motor and the developing motor. The clutch is movable between an engaging condition, in which the clutch engages transmission of a driving force from the second motor to the developing roller to cause rotation of the developing roller, and a disengaging condition, in which the clutch disengages the transmission of the driving force from the second motor to the developing roller. The clutch is in the engaging condition when the developing roller is located at the contacting position. The clutch is in the disengaging condition when the developing roller is located at the separated position. The contact/separation cam is configured to move the developing roller. The contact/separation cam is rotatable between a first phase, in which the contact/separation cam locates the developing roller at the contacting position, and a second phase, in which the contact/separation cam locates the developing roller at the separated position. The switching cam is configured to switch the clutch between the engaging condition and the disengaging condition. The switching cam is rotatable between a first phase, in which the switching cam places the clutch in the engaging condition, and a second phase, in which the switching cam places the clutch in the disengaging condition. The controller is configured to control the first motor and the second motor. The developing roller is located at the contacting position when the cover is located at the open position. The controller is configured to conduct a first process, in which, when the cover is moved from the open position to the closed position, the controller drives the first motor without driving the second motor to rotate the photosensitive drum without causing the rotation of the developing roller; and a second process, in which, after a lapse of a first period since the controller started driving the first motor, the controller drives the second motor to move the contact/separation cam from the first phase to the second phase and move the switching cam from the first phase to the second phase causing the developing roller to be moved from the contacting position to the separated position while the photosensitive drum is rotating.

BRIEF DESCRIPTION OF THE ACCOMPANYING DRAWINGS

Figure 6B:
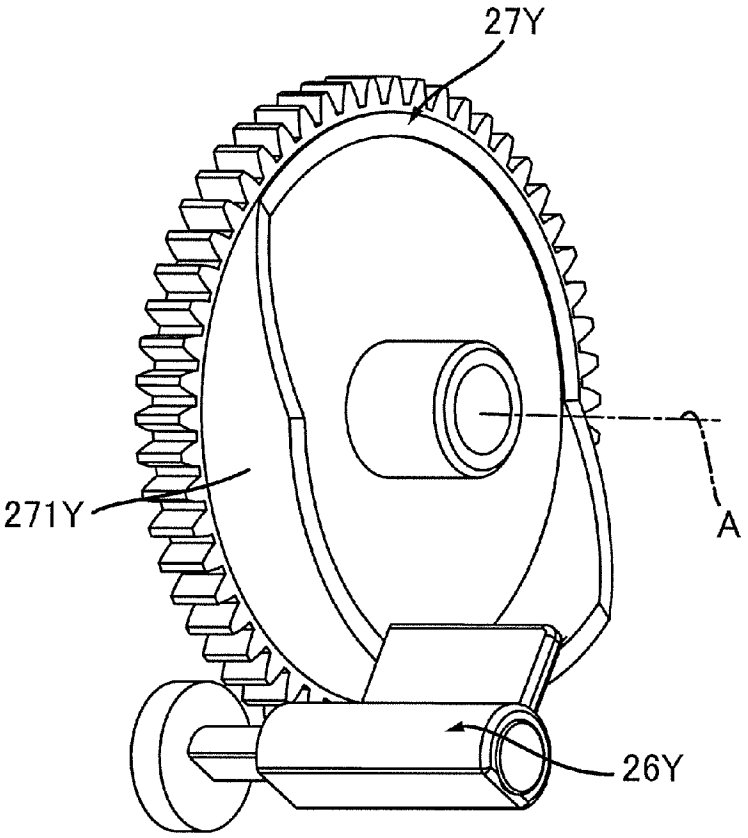
Figure 6A:
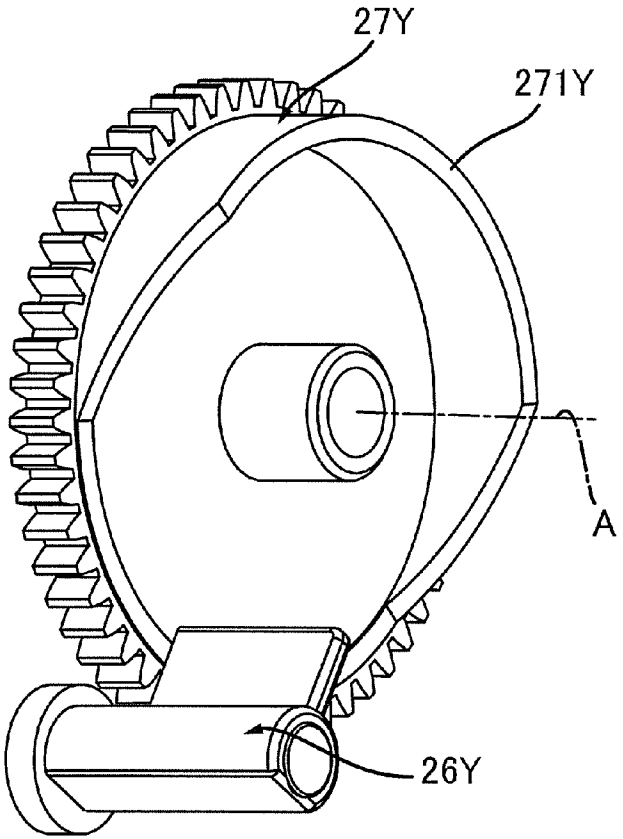

FIG. 6A is a perspective view of a gear and a contact/separation member when the contact/separation cam is in a first phase and the contact/separation member is at a position to locate the developing roller at a contacting position. FIG. 6B is a perspective view of the gear and the contact/separation member when the contact/separation cam is in a second phase and the contact/separation member is at a position to locate the developing roller at a separated position.

Figure 7A:
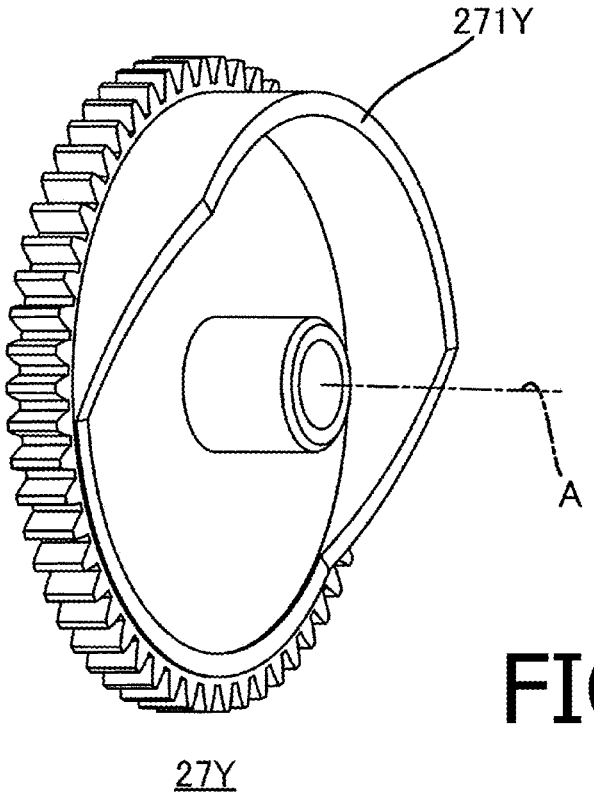
Figure 7B:
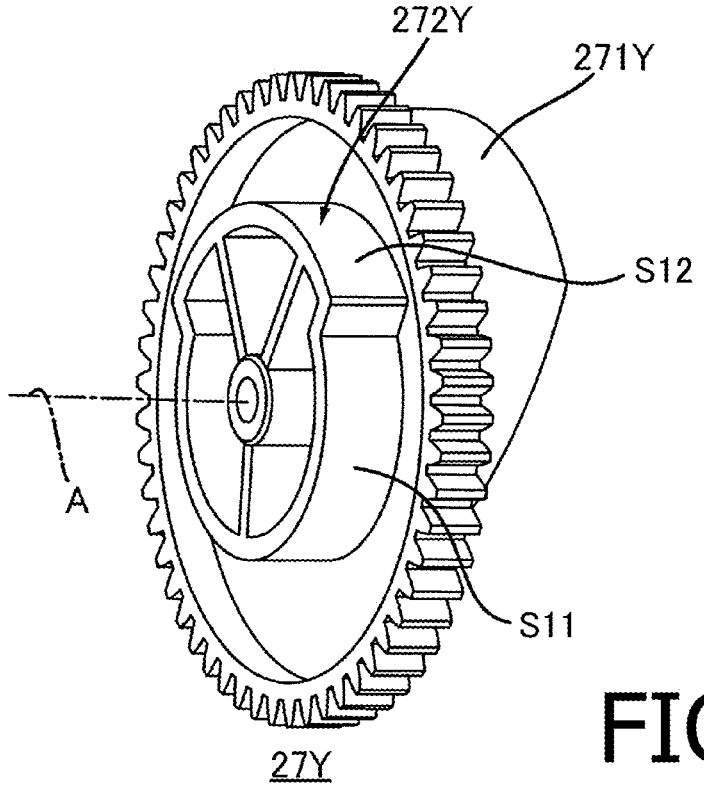

FIG. 7A is a perspective view of the gear without the contact/separation member according to the embodiment of the present disclosure. FIG. 7B is another perspective view of the gear, viewed in a different angle, according to the embodiment of the present disclosure.

Figure 8B:
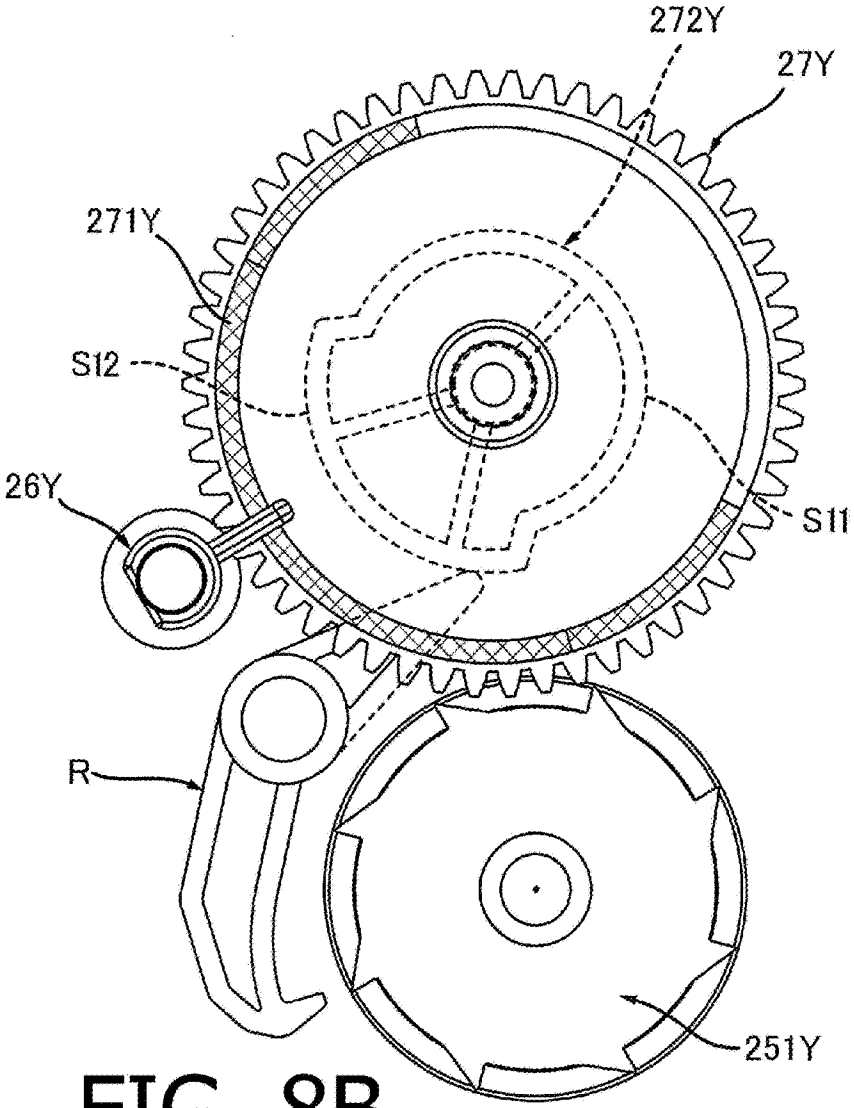
Figure 8A:
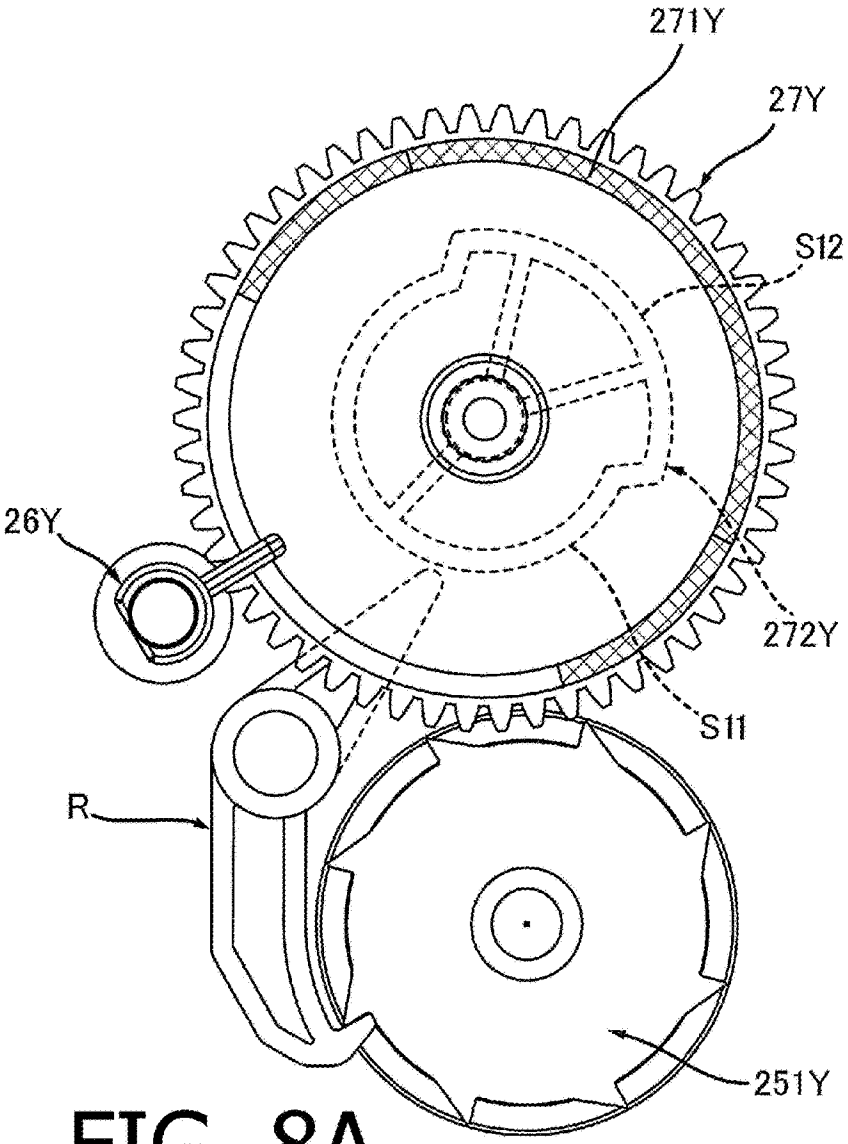

FIG. 8A is a plan view of the gear, the contact/separation member, and a clutch, when the contact/separation cam is in the first phase and a switching cam is in a first phase, in the image forming apparatus according to the embodiment of the present disclosure. FIG. 8B is a plan view of the gear, the contact/separation member, and the clutch, when the contact/separation cam is in a second phase and the switching cam is in a second phase, in the image forming apparatus according to the embodiment of the present disclosure.

Figure 9:
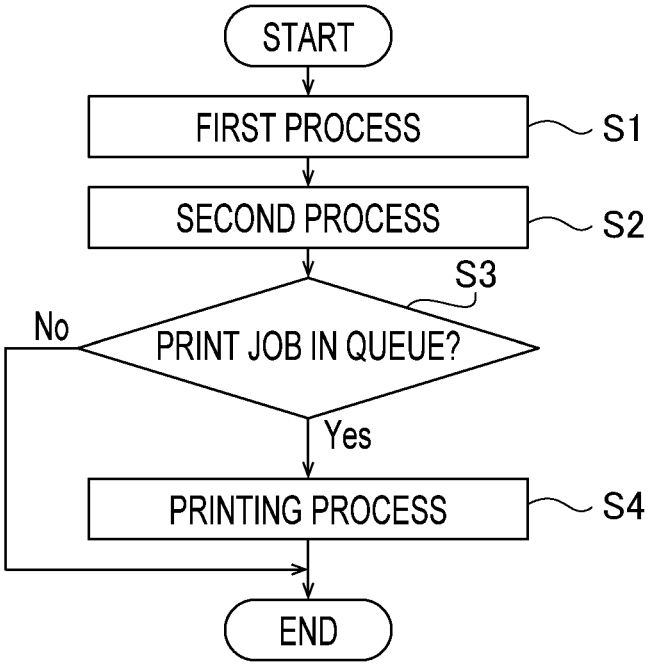

FIG. 9 is a flowchart to illustrate a flow to control the image forming apparatus according to the embodiment of the present disclosure.

Figure 10:
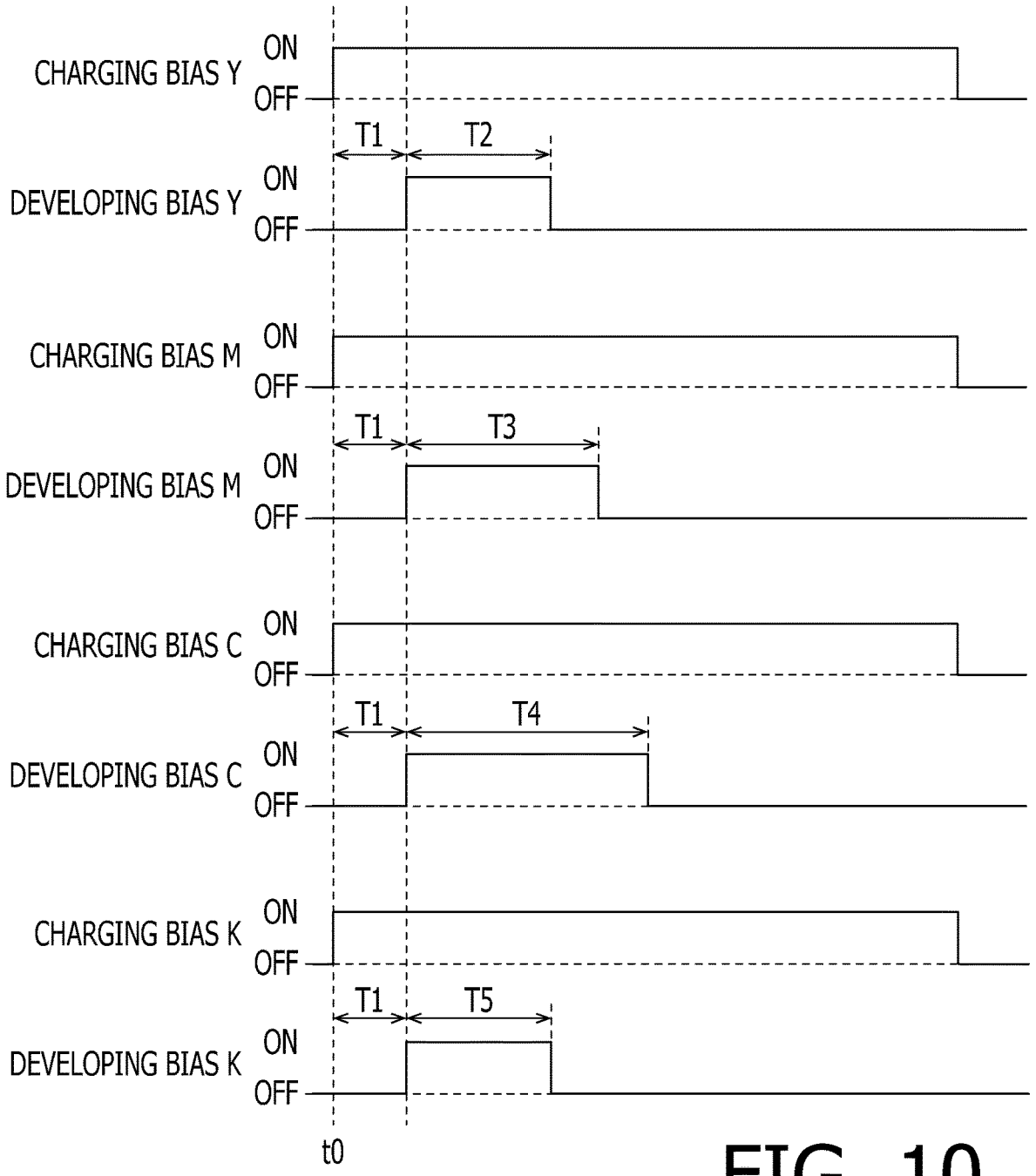

FIG. 10 is a timing chart to illustrate timings to apply charging bias and developing bias to chargers and the developing rollers in the image forming apparatus according to the embodiment of the present disclosure.

DETAILED DESCRIPTION

Hereinafter, described in detail with reference to the accompanying drawings will be an embodiment of the present disclosure.

1. Overall Configuration of Image Forming Apparatus

Figure 1:
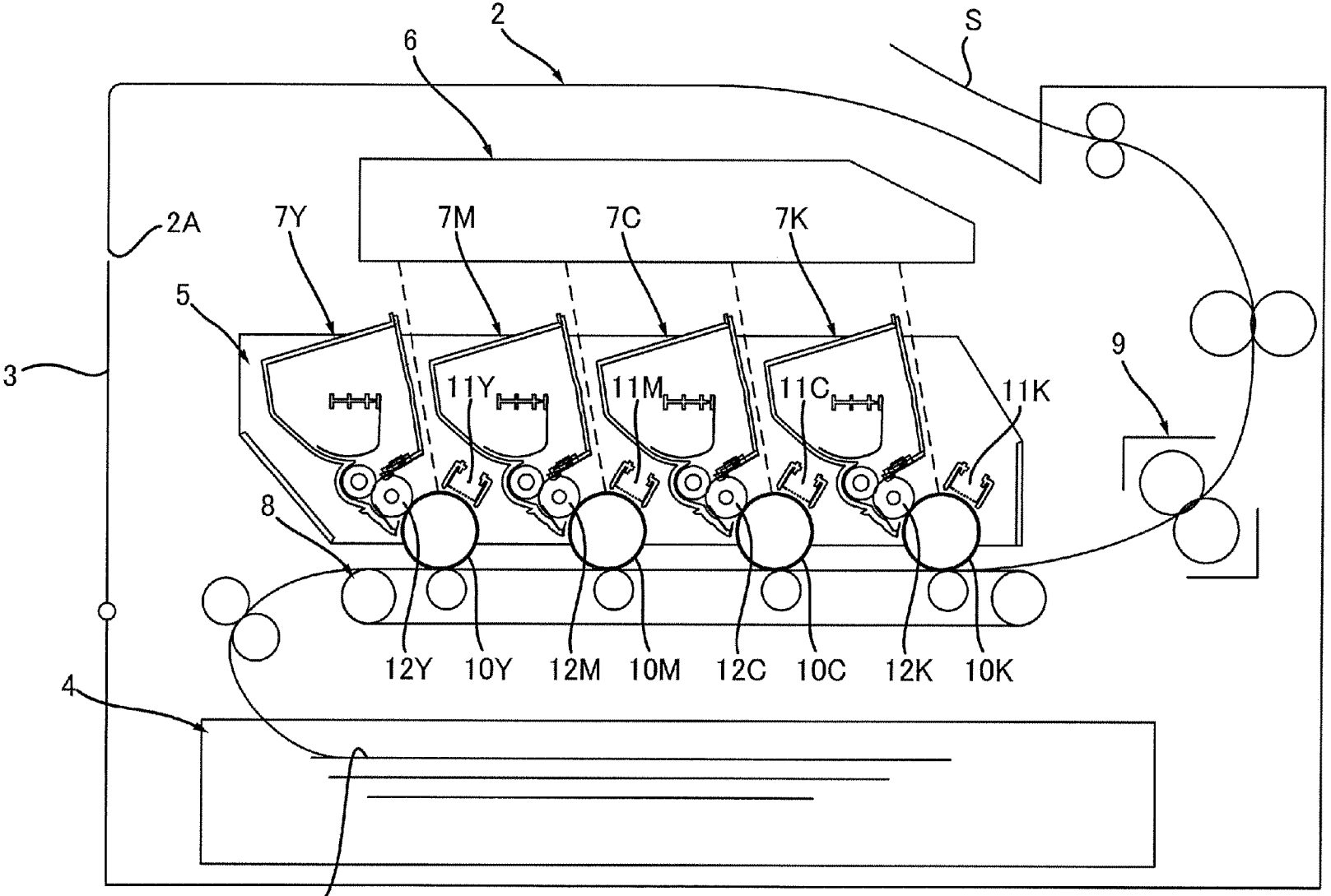
FIG. 1 is an illustrative cross-sectional view of an image forming apparatus according to an embodiment of the present disclosure.
Figure 2:
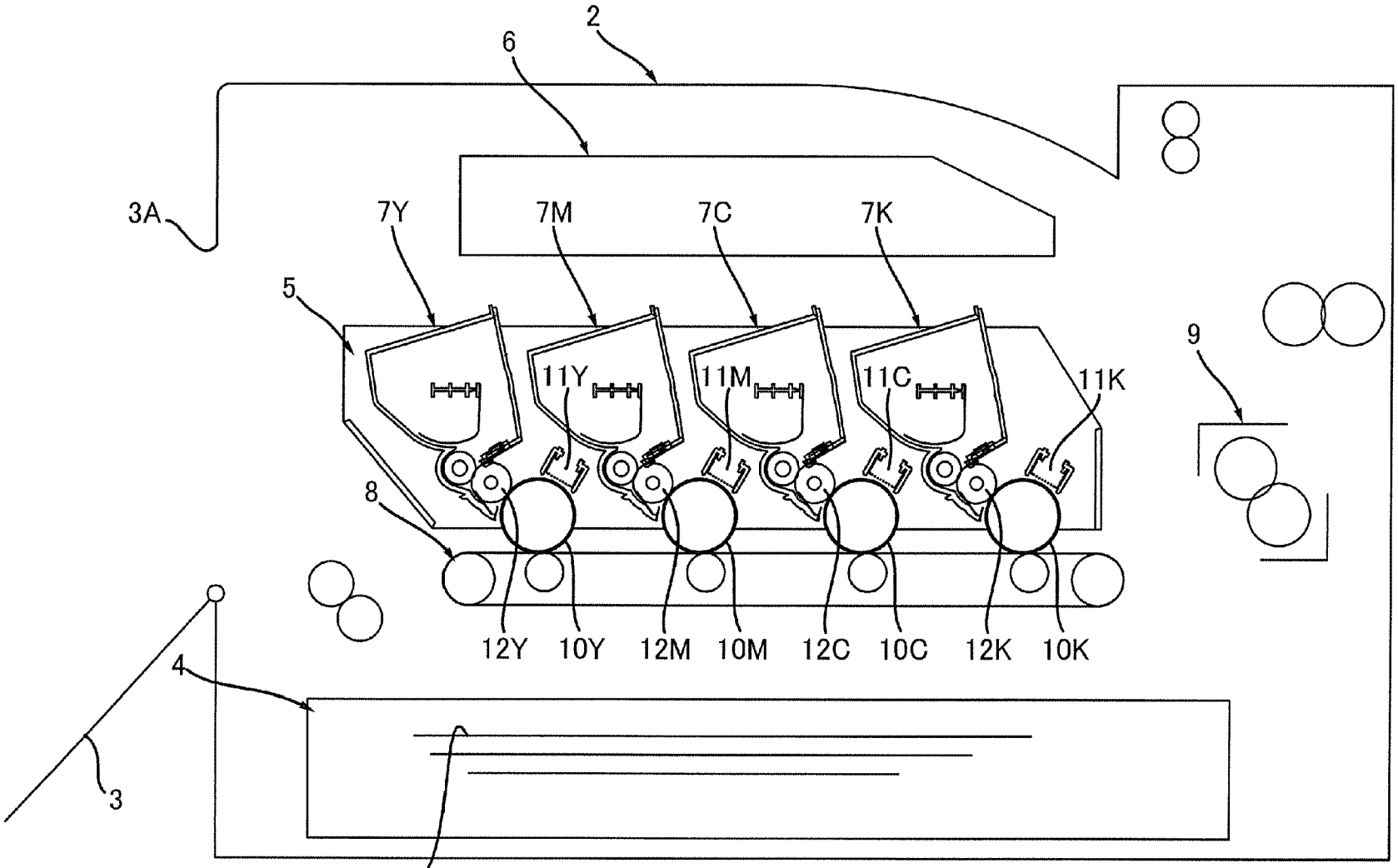
FIG. 2 is an illustrative cross-sectional view of the image forming apparatus, with a cover at an open position, according to the embodiment of the present disclosure.
Figure 3:
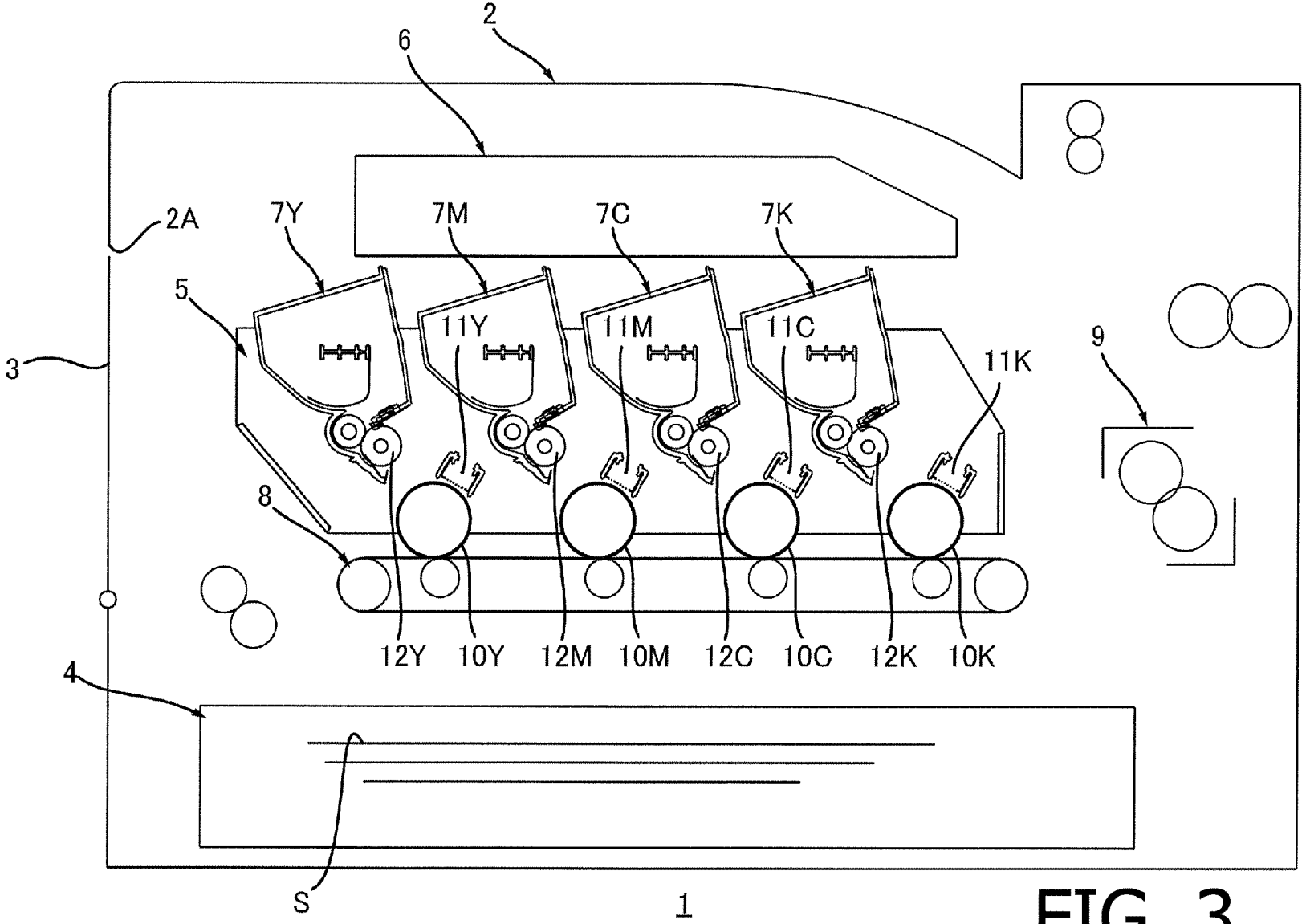
FIG. 3 is an illustrative cross-sectional view of the image forming apparatus, with developing rollers at respective separated positions, according to the embodiment of the present disclosure.

With reference to FIGS. 1-3, an overall configuration of an image forming apparatus 1 will be described.

As shown in FIG. 1, the image forming apparatus 1 includes a casing 2, a cover 3, a sheet cassette 4, a drum unit 5, an exposure device 6, developing cartridges 7Y, 7M, 7C, 7K, a transfer device 8, and a fuser 9.

1.1 Casing

The casing 2 accommodates components including, but not necessarily limited to, the sheet cassette 4, the drum unit 5, the exposure device 6, the developing cartridges 7Y, 7M, 7C, 7K, the transfer device 8, and the fuser 9. The casing 2 has an opening 2A.

1.2 Cover

As shown in FIGS. 1 and 2, the cover 3 is movable between a closed position (see FIG. 1) and an open position (see FIG. 2). When the cover 3 is at the closed position, the cover 3 closes the opening 2A. When the cover 3 is at the open position, the opening 2A is exposed open.

1.3 Sheet Cassette

As shown in FIG. 1, the sheet cassette 4 may store one or more sheets S. The sheets S stored in the sheet cassette 4 may be conveyed toward photosensitive drums 10Y, 10M, 10C, 10K and the fuser 9, which will be described further below. The sheets S may be, for example, printing paper.

1.4 Drum Unit

The drum unit 5 may be drawn outward from the casing 2 through the opening 2A when the cover 3 is at the open position (see FIG. 2). The drum unit 5 includes the photosensitive drums 10Y, 10M, 10C, 10K and chargers 11Y, 11M, 11C, 11K. In other words, the image forming apparatus 1 includes the photosensitive drums 10Y, 10M, 10C, 10K and the chargers 11Y, 11M, 11C, 11K.

1.4.1 Photosensitive Drums

The photosensitive drum 10Y is rotatable about an axis, which extends in a first direction. The photosensitive drum 10Y has a cylindrical form and extends longitudinally along the axis in the first direction.

The photosensitive drums 10M, 10C, 10K may be explained in the same manner as the photosensitive drum 10Y; therefore, description of each of the photosensitive drums 10M, 10C, 10K will be herein omitted.

The photosensitive drums 10Y, 10M, 10C, 10K align in a second direction, which intersects with the first direction. Preferably, the second direction intersects orthogonally with the first direction.

1.4.2 Chargers

The charger 11Y may electrically charge a circumferential surface of the photosensitive drum 10Y. The charger 11M may electrically charge a circumferential surface of the photosensitive drum 10M. The charger 11C may electrically charge a circumferential surface of the photosensitive drum 10C. The charger 11K may electrically charge a circumferential surface of the photosensitive drum 10K.

1.5 Exposure Device

The exposure device 6 may expose the photosensitive drum 10Y to light. After the charger 11Y electrically charges the circumferential surface of the photosensitive drum 10Y, the exposure device 6 may emit light at the charged circumferential surface of the photosensitive drum 10 to form an electrostatic latent image on the circumferential surface of the photosensitive drum 10Y. Meanwhile, the circumferential surfaces of the photosensitive drums 10M, 10C, 10K may be exposed by the exposure device 6 likewise. The exposure device 6 may be, for example, a laser scanning unit to scan the circumferential surfaces of the photosensitive drums 10Y, 10M, 10C, 10K by laser beams. For another example, the exposure device 6 may be an LED unit having LED arrays.

1.6 Developing Cartridges

The developing cartridge 7Y is attachable to the drum unit 5 and may contain toner. The developing cartridge 7Y includes a developing roller 12Y In other words, the image forming apparatus 1 includes the developing roller 12Y.

The developing roller 12Y is rotatable about an axis, which extends in the first direction. The developing roller 12Y has a cylindrical form and extends longitudinally along the axis in the first direction. The developing roller 12Y is accommodated partly in the developing cartridge 7Y and partly exposed outside the developing cartridge 7Y. The developing roller 12Y may contact the circumferential surface of the photosensitive drum 10Y when the developing cartridge 7Y is attached to the drum unit 5 and the drum unit 5 is located inside the casing 2. Through the contact with the photosensitive drum 10, the developing roller 12Y may supply the toner in the developing cartridge 7Y to the circumferential surface of the photosensitive drum 10Y. With the toner being supplied from the developing cartridge 7Y to the circumferential surface of the photosensitive drum 10Y by the developing roller 12Y, the electrostatic latent image may be developed on the circumferential surface of the photosensitive drum 10Y to form a toner image.

As shown in FIGS. 1 and 3, the developing cartridge 7Y is, when the drum unit 5 with the developing cartridge 7Y attached thereto is located inside the casing 2, movable between a position, in which the developing roller 12Y contacts the photosensitive drum 10Y (see FIG. 1), and a position, in which the developing roller 12Y is separated from the photosensitive drum 10Y (see FIG. 3). In other words, the developing roller 12Y is movable between a contacting position, in which the developing roller 12Y contacts the photosensitive drum 10Y (see FIG. 1), and a separated position, in which the developing roller 12Y is separated from the photosensitive drum 10Y (see FIG. 3).

The developing cartridges 7M, 7C, 7K may be explained in the same manner as the developing cartridge 7Y; therefore, description of each of the developing cartridges 7M, 7C, 7K will be herein omitted.

As shown in FIG. 2, when the cover 3 is at the open position, the developing rollers 12Y, 12M, 12C, 12K are located at the respective contacting positions. When the cover 3 moves from the open position (see FIG. 2) to the closed position (see FIG. 1), the developing rollers 12Y, 12M, 12C, 12K may move from the respective contacting positions (see FIG. 1) to the respective separated positions (see FIG. 3). Moreover, the developing roller 12Y may move from the separated position thereof to the contacting position thereof according to a timing to form a toner image on the photosensitive drum 10Y. Similarly, the developing roller 12M may move from the separated position thereof to the contacting position thereof according to a timing to form a toner image on the photosensitive drum 10M, the developing roller 12C may move from the separated position thereof to the contacting position thereof according to a timing to form a toner image on the photosensitive drum 10C, and the developing roller 12K may move from the separated position thereof to the contacting position thereof according to timing to form a toner image on the photosensitive drum 10K.

1.7 Transfer Device

The transfer device 8, as shown in FIG. 1, may transfer the toner images formed on the photosensitive drums 10Y, 10M, 10C, 10K onto the sheet S. The sheet S conveyed from the sheet cassette 4 may travel through an area between the transfer device 8 and the photosensitive drums 10Y, 10M, 10C, 10K to be conveyed toward the fuser 9. As the sheet S travels through the area between the transfer device 8 and the photosensitive drums 10Y, 10M, 10C, 10K, the transfer device 8 may transfer the toner images formed on the photosensitive drums 10Y, 10M, 10C, 10K onto the sheet S.

1.8 Fuser

The fuser 9 may apply heat and pressure to the sheet S, on which the toner images are transferred, to fix the toner images on the sheet S. The sheet S conveyed through the fuser 9 may be ejected outside to rest on top of the casing 2.

2. Detailed Configuration of the Image Forming Apparatus

Next, with reference to FIGS. 4 through 8A-8B, described will be the detailed configuration of the image forming apparatus 1.

Figure 4:
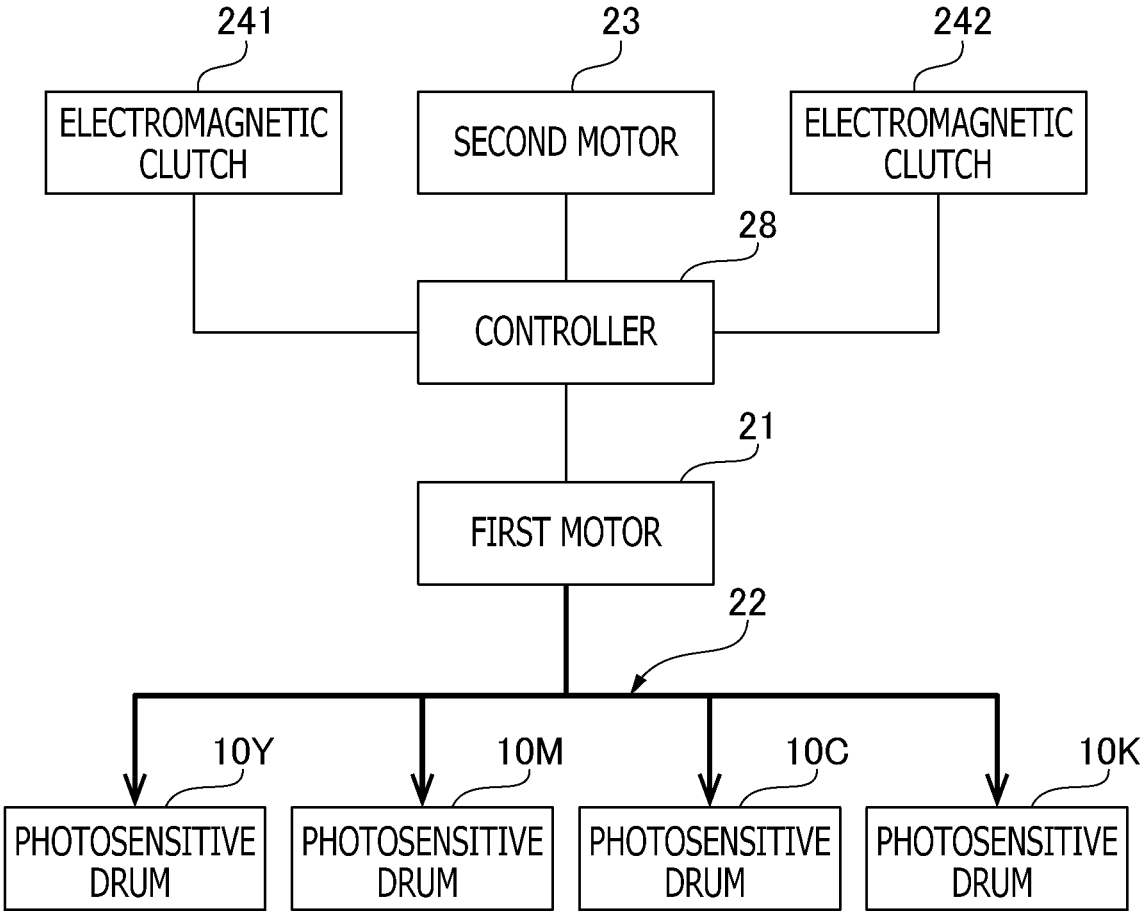
FIG. 4 is a block diagram to illustrate electrical connection of a first motor, a second motor, and electromagnetic clutches with a controller and transmission of a driving force from the first motor to photosensitive drums in the image forming apparatus according to the embodiment of the present disclosure.
Figure 5:
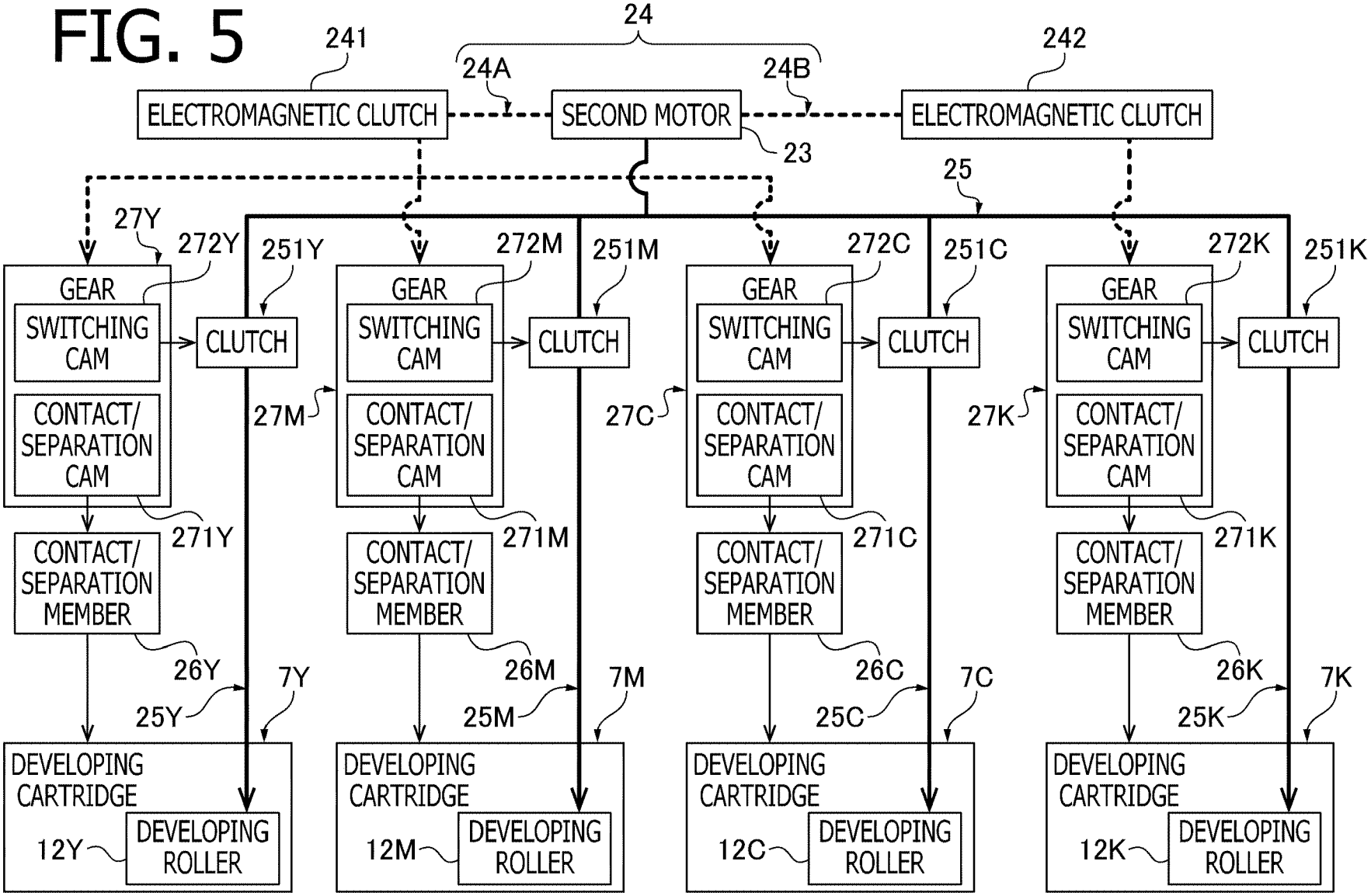
FIG. 5 is a block diagram to illustrate transmission of a driving force from the second motor to developing cartridges in the image forming apparatus according to the embodiment of the present disclosure.

As shown in FIGS. 4 and 5, the image forming apparatus 1 includes a first motor 21 (see FIG. 4), a gear train 22 (see FIG. 4), a second motor 23 (see FIGS. 4 and 5), a first gear train 24 (see FIG. 5), a second gear train 25 (see FIG. 5), four (4) contact/separation members 26Y, 26M, 26C, 26K (see FIG. 5), four (4) gears 27Y, 27M, 27C, 27K (see FIG. 5), and a controller 28 (see FIG. 4).

2.1 First Motor and Gear Train

As shown in FIG. 4, the first motor 21 is connected with the photosensitive drums 10Y, 10M, 10C, 10K through the gear train 22. When the motor 21 is operating, a driving force from the first motor 21 may be transmitted to the photosensitive drums 10Y, 10M, 10C, 10K through the gear train 22. In other words, the photosensitive drums 10Y, 10M, 10C, 10K are rotatable by the driving force from the first motor 21.

2.2 Second Motor

As shown in FIG. 5, the second motor 23 is connected with the gears 27Y, 27M, 27C, 27K through the first gear train 24.

Further, the second motor 23 is connected with the developing cartridges 7Y, 7M, 7C, 7K through the second gear train 25.

2.3 First Gear Train

The first gear train 24 includes a gear train 24A and a gear train 24B.

The gear train 24A is connected with the gears 27Y, 27M, 27C. Therefore, the gear train 24A may transmit the driving force from the second motor 23 to the gears 27Y, 27M, 27C. Moreover, the first gear train 24 may transmit the driving force from the second motor 23 to contact/separation cams 271Y, 271M, 271C, which will be described further below. The gear train 24A includes an electromagnetic clutch 241. In other words, the first gear train 24 includes the electromagnetic clutch 241.

The electromagnetic clutch 241 is switchable between an ON state and an OFF state. When the electromagnetic clutch 241 is in the ON state, the electromagnetic clutch 241 is powered and may engage transmission of the driving force from the second motor 23 to the gears 27Y, 27M, 27C. Therefore, when the electromagnetic clutch 241 is in the ON state, the electromagnetic clutch 241 may transmit the driving force from the second motor 23 to the contact/separation cams 271Y, 271M, 271C. On the other hand, when the electromagnetic clutch 241 is in the OFF state, the electromagnetic clutch 241 is unpowered and may disengage the transmission of the driving force from the second motor 23 to the gears 27Y, 27M, 27C. Therefore, when the electromagnetic clutch 241 is in the OFF state, the electromagnetic clutch 241 may not transmit the driving force from the second motor 23 to the contact/separation cams 271Y, 271M, 271C.

The gear train 24B is connected with the gear 27K. Therefore, the gear train 24B may transmit the driving force from the second motor 23 to the gear 27K. The gear train 24B includes an electromagnetic clutch 242.

When the electromagnetic clutch 242 is in the ON state, the electromagnetic clutch 242 may engage transmission of the driving force from the second motor 23 to the gear 27K. When the electromagnetic clutch 242 is in the OFF state, the electromagnetic clutch 242 may disengage the transmission of the driving force from the second motor 23 to the gear 27K.

2.4 Second Gear Train

The second gear train 25 includes gear trains 25Y, 25M, 25C, 25K.

The gear train 25Y is connected with the developing cartridge 7Y Therefore, the gear train 25Y may transmit the driving force from the second motor 23 to the developing cartridge 7Y The driving force transmitted to the developing cartridge 7Y is transmitted to the developing roller 12Y (see FIG. 1) through a gear train, which is not shown, in the developing cartridge 7Y In other words, the second gear train 25 may transmit the driving force from the second motor 23 to the developing roller 12Y The gear train 25Y includes a clutch 251Y. In other words, the second gear train 25 includes the clutch 251Y, and the image forming apparatus 1 includes the clutch 251Y.

The clutch 251Y is arranged at an intermediate position in the gear train 25Y In other words, the clutch 251Y is located between the second motor 23 and the developing roller 12Y The clutch 251Y is switchable between an engaging condition and a disengaging condition. When the clutch 251Y is in the engaging condition, the clutch 251Y may engage transmission of the driving force from the second motor 23 to the developing cartridge 7Y. Therefore, when the clutch 251Y is in the engaging condition, the clutch 251Y may transmit the driving force from the second motor 23 to the developing roller 12Y to cause rotation of the developing roller 12Y When the clutch 251Y is in the disengaging condition, on the other hand, the clutch 251Y may not engage the transmission of the driving force from the second motor 23 to the developing cartridge 7Y Therefore, when the clutch 251Y is in the disengaging condition, the clutch 251Y may not transmit the driving force from the second motor 23 to the developing roller 12Y, and the developing roller 12Y may not be rotated.

The gear train 25M is connected with the developing cartridge 7M. The gear train 25C is connected with the developing cartridge 7C. The gear train 25K is connected with the developing cartridge 7K. The gear trains 25M, 25C, 25K may be explained in the same manner as the gear train 25Y; therefore, description of each of the gear trains 25M, 25C, 25K will be herein omitted.

2.5 Contact/Separation Member

The contact/separation member 26Y shown in FIG. 5 may move the developing cartridge 7Y. Therefore, the contact/separation member 26Y may move the developing roller 12Y (see FIG. 1) between the contacting position and the separated position.

In particular, as shown in FIGS. 6A-6B, the contact/separation member 26Y is movable between a position, in which the developing roller 12Y is placed at the contacting position (see FIG. 6A), and a position, in which the developing roller 12Y is placed at the separated position (see FIG. 6B).

The contact/separation members 26M, 26C, 26K may be explained in the same manner as the contact/separation member 26Y; therefore, description of each of the contact/separation members 26M, 26C, 26K will be herein omitted.

2.6 Gear

As shown in FIG. 5, the gear 27Y may receive the driving force from the second motor 23 through the gear train 24A. As shown in FIGS. 6A-6B, the gear 27Y is rotatable about an axis A.

As shown in FIGS. 7A and 7B, the gear 27Y includes the contact/separation cam 271Y and the switching cam 272Y. In other words, the image forming apparatus 1 includes the contact/separation cam 271Y and the switching cam 272Y. In particular, the gear 27Y includes the contact/separation cam and the switching cam 272Y integrally. In this integral form, the switching cam 272Y may rotate alongside the contact/separation cam 272Y about the axis A.

2.6.1 Contact/Separation Cam

As shown in FIG. 5, the contact/separation cam 271Y may move the contact/separation member 26Y. Therefore, the contact/separation cam 271Y may move the developing cartridge 7Y to move the developing roller 12Y through the contact/separation member 26Y.

In particular, as shown in FIG. 7A, the contact/separation cam 271Y is arranged on one side of the gear 27Y to protrude sideward from the one side of the gear 27Y. The contact/separation cam 271Y is arranged around the axis A to extend in a circumferential direction of the gear 27Y. The contact/separation cam 271Y is arranged on a part of a circumferential range of the gear 27Y.

As shown in FIGS. 6A and 6B, the contact/separation cam 271Y is rotatable alongside of rotation of the gear 27Y between a first phase (see FIG. 6A) and a second phase (see FIG. 6B). When the contact/separation cam 271Y is in the first phase, as shown in FIG. 6A, the contact/separation cam 271Y is separated from the contact/separation member 26Y. Therefore, when the contact/separation cam 271Y is in the first phase, the contact/separation member 26Y is at a position, in which the developing roller 12Y is located at the contacting position. In other words, when the contact/separation cam 271Y is in the first phase, the contact/separation cam 271Y locates the developing roller 12Y at the contacting position. On the other hand, when the contact/separation cam 271Y is in the second phase, as shown in FIG. 6B, the contact/separation cam 271Y may press the contact/separation member 26Y to locate the contact/separation member 26Y at a position, in which the developing roller 12Y is located at the separated position. In other words, when the contact/separation cam 271Y is in the second phase, the contact/separation cam 271Y locates the developing roller 12Y at the separated position.

2.6.2 Switching Cam

As shown in FIG. 5, the switching cam 272Y may switch conditions of the clutch 251Y.

In particular, as shown in FIG. 7B, the switching cam 272Y is located on the other side of the gear 27Y, on the side opposite to the contact/separation cam 271Y, to protrude sideward from the other side of the gear 27Y. The switching cam 272Y is arranged around the axis A. The switching cam 272Y includes a first circumferential face S11 and a second circumferential face S12. The first circumferential face S11 and the second circumferential face S12 extend in the circumferential direction of the gear 27Y. The second circumferential face S12 is arranged to be farther than the first circumferential face S11 from the axis A in the radial direction.

As shown in FIGS. 8A and 8B, the switching cam 272Y may switch conditions of the clutch 251Y through, for example, a lever R. The lever R is movable between a first lever position (see FIG. 8A), in which the lever R places the clutch 251Y in the engaging condition, and a second lever position (see FIG. 8B), in which the lever R places the clutch 251Y in the disengaging condition.

The switching cam 272Y is rotatable alongside the rotation of the gear 27Y between a first phase (see FIG. 8A) and a second phase (see FIG. 8B).

As shown in FIG. 8A, the switching cam 272Y is in the first phase when the contact/separation cam 271Y is in the first phase. When the switching cam 272Y is in the first phase, the switching cam 272Y is separated from the lever R. In this arrangement, the lever R is located in the first lever position. Therefore, when the switching cam 272Y is in the first phase, the switching cam 272Y places the clutch 251Y in the engaging condition. In other words, the clutch 251Y is in the engaging condition when the developing roller 12Y is located at the contacting position.

2.7 Controller

The controller 28 is, as shown in FIG. 4, connected with the first motor 21, the second motor 23, and the electromagnetic clutches 241, 242. The controller 28 may control the first motor 21, the second motor 23, and the electromagnetic clutches 241, 242.

3. Control of the Image Forming Apparatus

Next, described with reference to FIGS. 1 through 5 and FIGS. 7A-7B through 10 will be controls of the image forming apparatus 1 by the controller 28.

As described above, when the cover 3 is moved from the open position (see FIG. 1) to the closed position (see FIG. 3), the developing rollers 12Y, 12M, 12C, 12K may move from the respective contacting positions (see FIG. 1) to the respective separated positions (see FIG. 3).

Meanwhile, as shown in FIGS. 8A and 8B, the switching cam 272Y rotates alongside the contact/separation cam 271Y. With the contact/separation cam 271Y being located at the contacting position, the switching cam 272Y places the clutch 251 in the engaging condition. Therefore, when the developing roller 12Y is moved from the contacting position to the separated position, the driving force from the second motor 23 is maintained transmitted to the developing cartridge 7Y as long as the rotating switching cam 272Y is in the first phase, until the switching cam 272Y rotating shifts to the second phase.

In this regard, while the photosensitive drum 10Y stays still without rotating, and if the developing roller 12Y being rotated is moved from the contacting position to the separated position, the developing roller 12Y at the contacting position may idle on the circumferential surface of the photosensitive drum 10Y staying still and rub a part of the circumferential surface of the photosensitive drum 10Y, which is in contact with the developing roller 12Y, intensively.

In the light of this concern, when the cover 3 moves from the open position (see FIG. 2) to the closed position (see FIG. 1), the controller 28 may control the photosensitive drums 10Y, 10M, 10C, 10K to be rotating when the developing rollers 12Y, 12M, 12C, 12K are moved from the respective contacting positions to the respective separated positions (see FIG. 3) by conducting a first process (S1) and a second process (S2) as shown in FIG. 9.

3.1 First Process

In the first process (S1) shown in FIG. 9, the controller 28 drives the first motor 21 (see FIG. 4) to rotate the photosensitive drums 10Y, 10M, 10C, 10K without driving the second motor 23 so that the developing rollers 12Y, 12M, 12C, 12K may not be rotated.

Meanwhile, as shown in FIG. 10, the controller 28 applies charging bias to the charger 11Y at time t0, at which the controller 28 starts driving the first motor 21.

With the charging bias applied to the charger 11Y at time t0, at which the controller 28 starts driving the first motor 21, the charging bias may be applied to the charger 11Y before the photosensitive drum 10Y starts rotating.

Moreover, the controller 28 applies the charging bias to the chargers 11M, 11C, 11K likewise at time t0.

3.2 Second Process

Next, in the second process (S2) shown in FIG. 9, the controller 28 switches the electromagnetic clutches 241, 242 (see FIG. 5) to the ON state and, after a first period T1 since the controller 28 started driving the first motor 21 elapses, drives the second motor 23. The first period T1 is a length between a time, at which the first motor 21 is started driving, and a time, at which the photosensitive drum 10Y starts rotating.

In this arrangement, the controller 28 may move the contact/separation cam 271Y from the first phase (see FIGS. 7A and 8A) to the second phase (see FIGS. 7B and 8B), the switching cam 272Y from the first phase (see FIG. 8A) to the second phase (see FIG. 8B) so that the developing roller 12Y may be moved from the contacting position to the separated position while the photosensitive drum 10Y is rotating.

Thus, moving the developing roller 12Y from the contacting position to the separated position while the photosensitive drum 10Y is rotating may prevent the developing roller 12Y from rotating on the photosensitive drum 10Y staying still. Therefore, the part of the circumferential surface of the photosensitive drum 10Y, at which the developing roller 12Y contacts the photosensitive drum 10Y, may be prevented from being intensively rubbed.

Moreover, as shown in FIG. 10, the controller 28 applies the developing bias to the developing roller 12Y after the first period T1 elapses since the controller 28 started driving the first motor 21. The developing bias is a voltage at the same polarity as the charging bias and is lower than the charging bias. Optionally, the controller 28, switching the electromagnetic clutch 241 (see FIG. 5) to the ON state and driving the second motor 23, may simultaneously apply the developing bias to the developing roller 12Y. Alternately, the controller 28, switching the electromagnetic clutch 241 to the ON state, may apply the developing bias to the developing roller 12Y before driving the second motor 23.

In other words, the controller 28 may, while applying the charging bias to the charger 11Y, and after the lapse of the first period T1, that is, after the photosensitive drum 10Y starts rotating, rotate the developing roller 12Y and simultaneously apply the developing bias to the developing roller 12Y.

Thereby, the developing roller 12Y may be rotated after the photosensitive drum 10Y started rotating while the toner on the developing roller 12Y may be prevented from being transferred to the photosensitive drum 10Y.

With the electromagnetic clutch 241 being in the ON state and the second motor 23 being driven, the developing roller 12M may, in the same manner as the developing roller 12Y, move from the contacting position to the separated position while the photosensitive drum 10M is rotating; the developing roller 12C may, in the same manner as the developing roller 12Y, move from the contacting position to the separated position while the photosensitive drum 10C is rotating; and the developing roller 12K may, in the same manner as the developing roller 12Y, move from the contacting position to the separated position while the photosensitive drum 10K is rotating. Meanwhile, the controller 28 may apply the developing bias to the developing rollers 12M, 12C, 12K likewise after the first period T1 elapses since the controller 28 started driving the first motor 21.

Further, in the second process (S2) shown in FIG. 9, the controller 28 switches the electromagnetic clutch 241 to the OFF state at a timing when the contact/separation cams 271Y, 271M, 271C all enter the second phase and when the switching cams 272Y, 272M, 272C all enter the second phase.

In particular, after a second period T2 since the controller 28 started driving the second motor 23 elapses, the controller 28 switches the electromagnetic clutch 241 to the OFF state. The second period T2 is a length between a time, at which the developing bias started to be applied to the developing roller 12Y, and a time, at which the developing roller 12Y is located at the separated position.

Moreover, as shown in FIG. 10, the controller 28 stops applying the developing bias to the developing roller 12Y after the second period 12 elapses since the controller 28 started applying the developing bias to the developing roller 12Y. Optionally, the controller 28, switching the electromagnetic clutch 241 to the OFF state, may simultaneously stop applying the developing bias to the developing roller 12Y. Alternately, the controller 28 may switch the electromagnetic clutch 241 to the ON state and thereafter stop applying the developing bias to the developing roller 12Y.

Further, after a lapse of a third period T3, which is between the time, at which the developing bias started to be applied to the developing roller 12Y, and a time, at which the developing roller 12M is located at the separated position, the controller 28 stops applying the developing bias to the developing roller 12; after a lapse of a fourth period 14, which is at which the developing bias started to be applied to the developing roller 12Y, and a time, at which the developing roller 12C is located at the separated position, the controller 28 stops applying the developing bias to the developing roller 12C; and after a lapse of a fifth period T5, which is between the time, at which the developing bias started to be applied to the developing roller 12Y, and a time, at which the developing roller 12K is located at the separated position, the controller 28 stops applying the developing bias to the developing roller 12K.

The lengths of the second period 12, the third period 13, the fourth period T4, and the fifth period T5 may or may not necessarily be the same as one another. For example, the lengths of the second period 12, the third period T3, the fourth period T4, and the fifth period T5 may be different from one another. In the present embodiment, the third period T3 is longer than the second period T2, the fourth period T4 is longer than the third period T3, and the fifth period T5 is the same as the second period T2.

3.3 Timings to Conduct the First Process and the Second Process

When the cover 3 moves from the open position to the closed position, the controller 28 conducts the first process (S1) and the second process (S2), and thereafter, if a print job is in queue (S3: YES), the controller 28 conducts a printing process (S4) to print an image on a sheet S.

In other words, when the cover 3 moves from the open position (see FIG. 2) to the closed position (see FIG. 1), the controller 28, prior to the printing process in S4, drives the first motor 21 to rotate the photosensitive drums 10Y, 10M, 10C, 10K and, while the photosensitive drums 10Y, 10M, 10C, 10K are rotating, drives the second motor 23 to move the developing rollers 12Y, 12M, 12C, 12K to be located at the respective separated positions.

4. Benefits

According to the image forming apparatus 1 in the present disclosure, when the cover 3 moves from the open position (see FIG. 2) to the closed position (see FIG. 1), in the first process (S1), as shown in FIG. 9, the controller 28 may control the photosensitive drum 10Y to rotate without causing the developing roller 12Y to rotate, and thereafter, in the second process (S2), while the photosensitive drum 10Y is rotating, the controller 28 may move the developing roller 12Y to the separated position.

Therefore, the developing roller 12Y may move from the contacting position to the separated position while the photosensitive drum 10Y is rotating.

In this regard, a rubbing behavior of the developing roller 12Y moving from the contacting position to the separated position to rub the part of the circumferential surface of the photosensitive drum 10Y that is in contact with the rotating developing roller 12Y may be prevented or restrained.

Thus, the photosensitive drum 10Y may be prevented or restrained from having abraded marks on the surface thereof.

Further, when the controller 28 conducts the second process (S2), as shown in FIGS. 8A and 8B, the switching cam 272Y rotates alongside the contact/separation cam 271Y to enter the second phase, as shown in FIG. 8B, with the contact/separation cam 271Y entering the second phase. In this regard, when the contact/separation cam 271Y is in the second phase, the developing roller 12Y is located at the separated position. Meanwhile, with the switching cam 272Y being in the second phase, the clutch 251 is placed in the disengaging condition, which discontinues the rotation of the developing roller 12Y.

Therefore, while the developing roller 12Y is separated from the photosensitive drum 10Y, the rotation of the developing roller 12Y may be stopped.

Moreover, as shown in FIGS. 7A and 7B, the gear 27Y includes the contact/separation cam 271Y and the switching cam 272Y integrally.

Therefore, as shown in FIGS. 8A and 8B, rotation of the switching cam 272Y may be reliably linked to rotation of the contact/separation cam 271Y.

Moreover, the first gear train 24, which may transmit the driving force from the second motor 23 to the contact/separation cam 271Y, is provided with the electromagnetic clutch 241.

Therefore, the contact/separation cam 271Y and the switching cam 272Y may be placed in the predetermined phases under the simple switching control of the electromagnetic clutch 241 between the ON state and the OFF state while the second motor 23 is being driven.

Moreover, as shown in FIG. 10, the controller 28 may apply the charging bias to the charger 11Y at the time t0, at which the controller 28 starts driving the first motor 21, and after driving the first motor 21 for the first period T1, which is the length required by the photosensitive drum 10Y to start rotating, the controller 28 may apply the developing bias to the developing roller 12Y.

In this arrangement, after the photosensitive drum 10Y started rotating, the developing roller 12Y may be rotated while the toner on the developing roller 12Y may be prevented from being transferred to the photosensitive drum 10Y.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

What is claimed is:

1. An image forming apparatus, comprising:

a casing having an opening;

a cover movable between a closed position, in which the cover closes the opening, and an open position, in which the opening is exposed;

a first motor;

a photosensitive drum configured to rotate by a driving force from the first motor;

a second motor;

a developing roller movable between a contacting position, in which the developing roller contacts the photosensitive drum, and a separated position, in which the developing roller is separated from the photosensitive drum;

a clutch located between the second motor and the developing roller, the clutch being switchable between:

an engaging condition, in which the clutch engages transmission of a driving force from the second motor to the developing roller to cause rotation of the developing roller, and a disengaging condition, in which the clutch disengages the transmission of the driving force from the second motor to the developing roller, the clutch being in the engaging condition when the developing roller is located at the contacting position, and the clutch being in the disengaging condition when the developing roller is located at the separated position;

a contact/separation cam configured to move the developing roller, the contact/separation cam being rotatable between a first phase, in which the contact/separation cam locates the developing roller at the contacting position, and a second phase, in which the contact/separation cam locates the developing roller at the separated position;

a switching cam configured to switch the clutch between the engaging condition and the disengaging condition, the switching cam being rotatable between a first phase, in which the switching cam places the clutch in the engaging condition, and a second phase, in which the switching cam places the clutch in the disengaging condition; and a controller configured to control the first motor and the second motor, wherein the developing roller is located at the contacting position when the cover is located at the open position;

wherein the controller is configured to conduct:

a first process, in which, when the cover is moved from the open position to the closed position, the controller drives the first motor without driving the second motor to rotate the photosensitive drum without causing the rotation of the developing roller; and a second process, in which, after a lapse of a first period since the controller started driving the first motor, the controller drives the second motor to move the contact/separation cam from the first phase to the second phase and move the switching cam from the first phase to the second phase causing the developing roller to be moved from the contacting position to the separated position while the photosensitive drum is rotating.

2. The image forming apparatus according to claim 1, further comprising:

a gear comprising the contact/separation cam and the switching cam integrally, the gear being configured to rotate by receiving the driving force from the motor.

3. The image forming apparatus according to claim 1, further comprising:

a first gear train transmittable of the driving force from the second motor to the contact/separation cam, the first gear train comprising an electromagnetic clutch, the electromagnetic clutch being switchable between an ON state, in which the electromagnetic clutch is powered and engages transmission of the driving force from the second motor to the contact/separation cam, and an OFF state, in which the electromagnetic clutch is unpowered and disengages the transmission of the driving force from the second motor without transmitting to the contact/separation cam; and a second gear train transmittable of the driving force from the second motor to the developing roller, the second gear train comprising the clutch, wherein, in the second process, the controller places the electromagnetic clutch in the ON state and drives the second motor to move the contact/separation cam from the first phase to the second phase and move the switching cam from the first phase to the second phase and thereafter places the electromagnetic clutch in the OFF state.

4. The image forming apparatus according to claim 1, wherein, when the cover is moved from the open position to the closed position, prior to conducting a printing process to print an image on a sheet, the controller drives the first motor to cause rotation of the photosensitive drum and drive the second motor to locate the developing roller at the separated position while the photosensitive drum is rotating.

5. The image forming apparatus according to claim 1, further comprising:

a charger configured to electrically charge a surface of the photosensitive drum, wherein the controller is configured to:

apply charging bias to the charger at a time when the controller drives the first motor; and after a lapse of the first period since the controller started driving the first motor, apply developing bias to the developing roller.

6. The image forming apparatus according to claim 5, wherein the controller applying the developing bias to the developing roller stops applying the developing bias after a lapse of a second period, the second period being between the time, at which the controller started driving the first motor, and a time, at which the developing roller being moved is located at the separated position.

* * * * *